United States Patent [19]

Terauds

[11] Patent Number: 4,687,117

[45] Date of Patent: Aug. 18, 1987

[54] FROZEN FOOD PACKAGE AND COVER LID

[75] Inventor: Oskar R. Terauds, Willoughby, Ohio

[73] Assignee: The Stouffer Corporation, Solon, Ohio

[21] Appl. No.: 897,387

[22] Filed: Aug. 18, 1986

[51] Int. Cl.[4] ..... B65D 41/16; B65D 41/18

[52] U.S. Cl. ..... 220/306; 150/55; 229/43

[58] Field of Search ..... 220/306, 367, 258; 206/527; 150/55; 229/2.5 R, 43

[56] References Cited

U.S. PATENT DOCUMENTS

| | | | |
|---|---|---|---|
| 3,902,540 | 9/1975 | Commisso | 150/55 |
| 3,904,074 | 9/1975 | Hoffman et al. | 220/258 |
| 3,935,962 | 2/1976 | Schubert et al. | 220/306 |
| 3,955,710 | 5/1976 | Commisso | 220/367 |
| 4,013,798 | 3/1977 | Goltsos | 426/107 |
| 4,061,241 | 12/1977 | Retelny | 220/4 B |
| 4,132,344 | 1/1979 | Jewell | 229/2.5 R |
| 4,146,170 | 3/1979 | Medendorp | 220/307 |
| 4,183,466 | 1/1980 | Davis | 220/306 |
| 4,351,447 | 9/1982 | Graff | 220/306 |
| 4,362,252 | 12/1982 | Graff | 220/306 |
| 4,375,862 | 3/1983 | Kurinsky et al. | 220/293 |
| 4,535,889 | 8/1985 | Terauds | 206/527 |

OTHER PUBLICATIONS

Prepared Foods, Gorman Publishing Company, p. 3, summer of 1986.

*Primary Examiner*—George T. Hall

*Attorney, Agent, or Firm*—Body, Vickers & Daniels

[57] ABSTRACT

A sheet plastic dome lid is provided for a generally rigid plastic frozen food receiving tray wherein a finger notch at one corner allows the lid to be flexed upwardly to release one of four locking ribs spaced substantially from the notch but on one side of the tray whereby a smooth camming action releases one locking rib so the others can immediately release the lid from the tray.

35 Claims, 13 Drawing Figures

FIG. 3
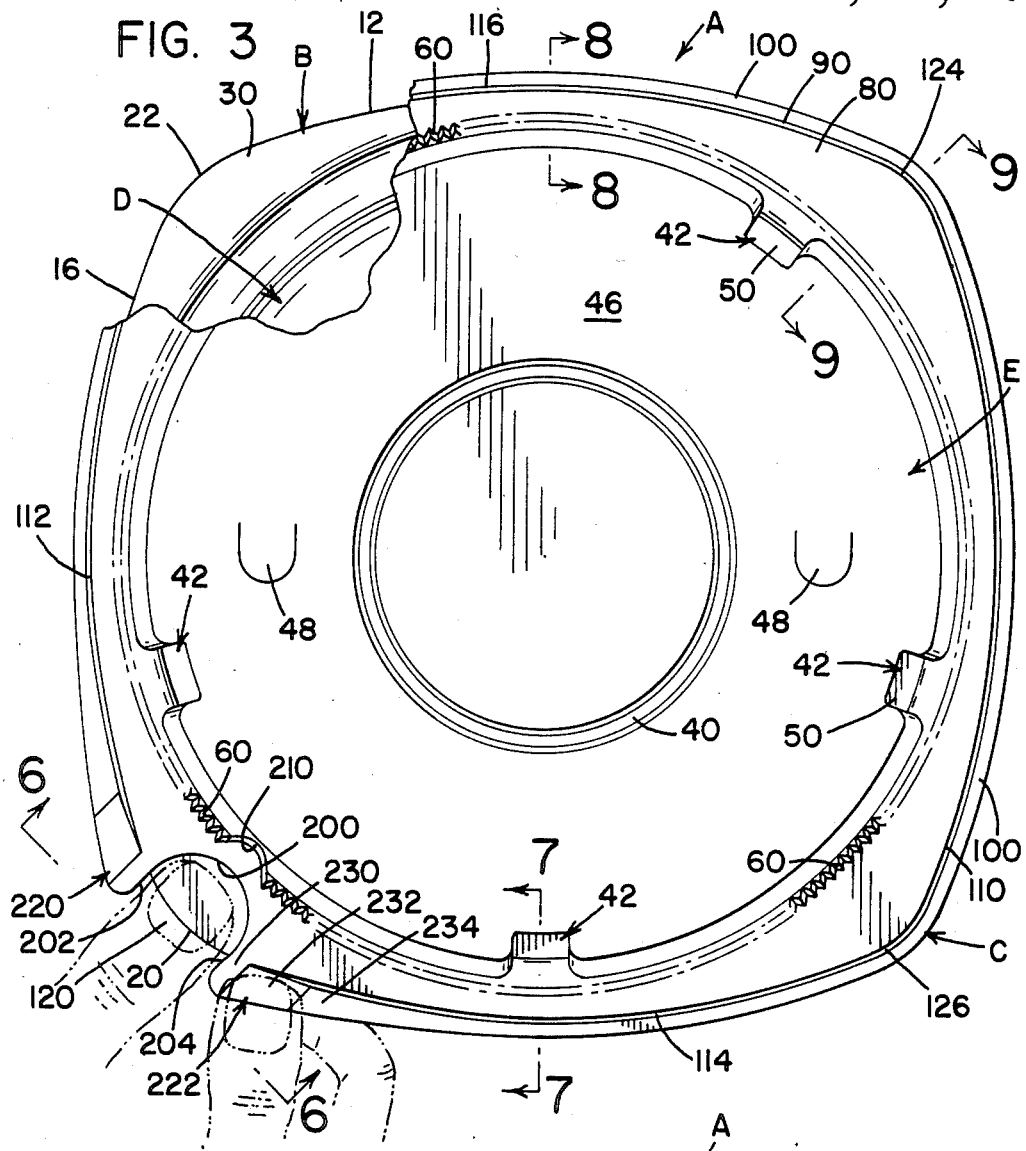
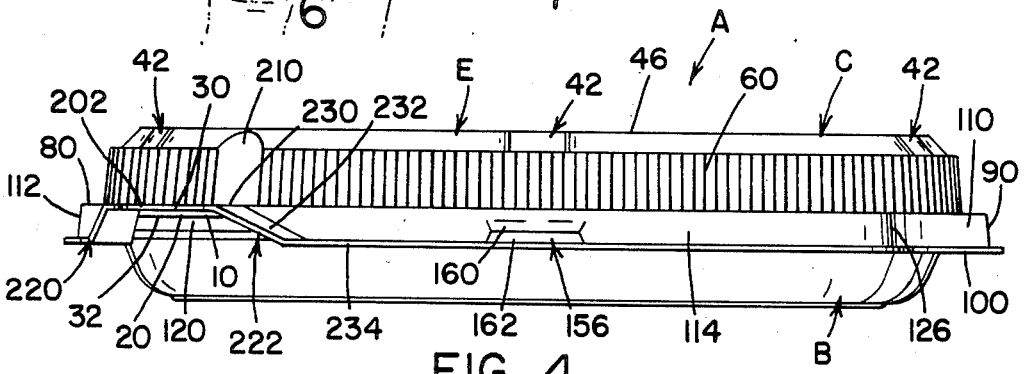
FIG. 4

FIG. 5
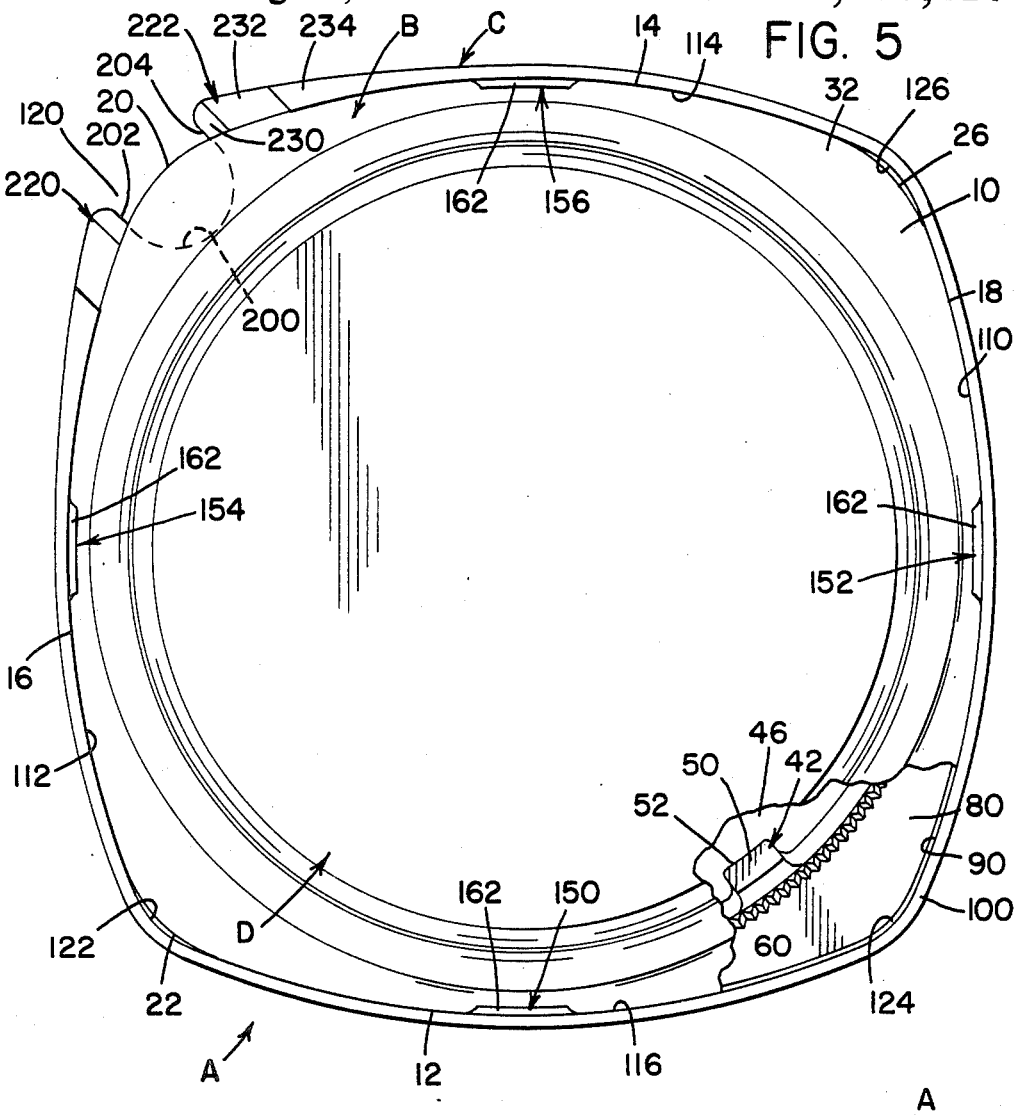
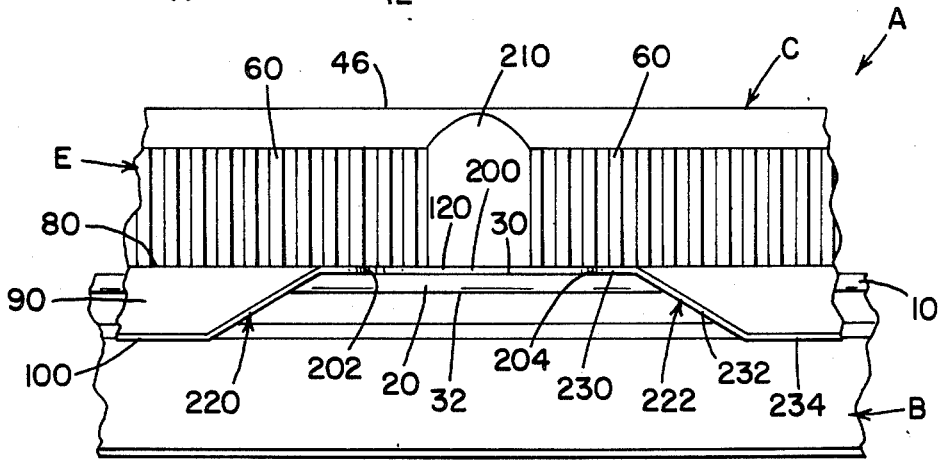
FIG. 6

FROZEN FOOD PACKAGE AND COVER LID

BACKGROUND OF THE INVENTION

The present invention relates in general to a package or container for frozen foods and, more particularly, to a frozen food package suitable for reconstitution of the frozen food either in a conventional type oven or in a microwave oven.

In the frozen food service industry, it is known to package the frozen food in containers or packaging adapted for the reconstitution of the frozen food for serving by the heating thereof either in a microwave oven or in a conventional radiant heat type oven. To this end, it has been customary to package the frozen food in a container comprised of a molded plastic bottom tray in which the frozen food is contained. The container is then closed by a metal foil layer sealed around the rim of the bottom tray. Then a removable semi-rigid preformed dome lid or cover of plastic sheet material is attached to the tray with the rim portion of the dome lid snap locked in place around the matching contour rim of the bottom tray.

To reconstitute the frozen food within such dual heatable type packages in a conventional oven, the plastic dome lid is unlocked and removed from the tray and the latter then placed, with its intermediate metal foil sealing layer left intact, in the heated oven at the required temperature and kept therein for the necessary time period to effect the heating and desired reconstitution of the frozen food in readiness for serving. However, to reconstitute the frozen food within such dual heatable type packages in a microwave oven, the plastic dome lid must be first carefully unlocked and removed from the bottom tray without ripping, tearing, or otherwise damaging the cover, the intermediate metal foil sealing layer then removed from the bottom tray to uncover the frozen food therein, and the dome lid then reattached to the bottom tray by again snap-locking it in place around the rim thereof before placing the frozen food containing tray in place in the microwave oven for the reconstitution of the frozen food in the tray. The removal of the metal foil layer from the tray prior to placement of the tray in and energization of the microwave oven is of course necessary in order to prevent the metal foil layer from absorbing and/or blocking the microwave rays from properly penetrating into the frozen food in the tray for the desired reconstitution thereof.

With the prior type frozen food packages, the detachment of the snap-locked-on cover from the bottom tray either for heating of the tray contents in a conventional oven or removal of the foil layer prior to heating of the package in a microwave oven, has generally been a difficult and inconvenient operation to perform, sometimes resulting in a tearing or ripping of the locking rim portion of the cover such as to prevent the subsequent locked-on reattachment of the cover to the tray for heating of the reassembled package in a microwave oven. In other instances, this difficulty in removal of the dome cover from the bottom tray has resulted, after the heating of the reassembled package in a microwave oven, in the accidental dropping of the still hot to handle package and spillage of the reconstituted food contents from the bottom tray, thus constituting a loss to the user.

SUMMARY OF THE INVENTION

The present invention contemplates a new and improved frozen food package or container suitable for heating and reconstitution of the packaged frozen food either in a conventional or a microwave oven and which overcomes all of the above referred to problems and others and provides a container comprised of a bottom tray with a dome lid snap locked thereonto which can be quickly and easily detached from the tray without damage and then snap locked back onto the tray, for reconstitution of the frozen food in a microwave oven.

Prior U.S. Pat. No. 4,535,889 illustrates applicant's earlier invention to accomplish this objective and is incorporated by reference herein.

Briefly stated, in accordance with one aspect of the invention, a frozen food package or container of the conventional type as described hereinabove for heating of the frozen food contents either in a conventional or microwave oven, and having four sides joined at corners is provided with a thumb notch recess in the seating flange of the dome lid at one corner thereof, for exposing a portion of the tray rim at this corner to enable the engagement thereof by a person's thumb. The thumb notch recess is spaced from two adjacent conventional locking ribs on sides intersecting said corner with the notch, such as to enable the grasping, between the thumb and fingers of a person's one hand, of the tray rim as well as the seating flange at the region spaced from one of the adjacent locking ribs, for convenient and effective application of a separating force to the tray and dome lid to effect the ready separation of the tray from the dome lid without any damage to the latter such as would prevent the reattachment thereof to the tray by the locking ribs on the dome lid.

In accordance with a further aspect of the invention, the tray and dome lid and the locking ribs thereon are so constructed as to provide a quick and easy pop-off disengagement of at least one of the locking ribs on the dome lid from the rim of the tray, on application of a separating force to the tray and to the seating flange of the dome lid at a region substantially spaced from such one locking rib.

In accordance with a still further aspect of the invention, the tray and dome lid are of a similar generally square contour with gradually rounded sides and corners, and the seating flange of the dome lid is provided with a tray rim engaging locking rib generally at the middle of the rounded sides of the dome lid and with a thumb notch recess located in the seating flange of the dome lid at approximately midway between the two locking ribs at a corner of the dome lid, whereby to afford convenient grasping of the container and pop-off disengagement of the dome lid from the tray by either one of a person's hands.

By using this invention, the snapping action disengaging the lid from the bottom tray is a gradual snapping action caused by the substantial distance of the notch from the disengaged locking rib and the use of a spaced portion against the notch for exerting the upward rib disengaging action. The flange causes a cantilever action modulating the upward force through the material in the seating flange between the area of engagement and the spaced rib. In this manner, no jerking action is caused by normal snapping of the cover lid from the bottom tray. This is important in preventing inconvenience to users of the tray since a smooth separation occurs each time the lid is removed irrespective of the care employed or the dexterity of the user.

The word "thumb" is only descriptive in nature and not intended to be in any way limiting. Clearly persons can use the new dome lid by use of other fingers in the disclosed notch. Further, other procedure could be employed for disengaging the lid from the bottom tray.

The principal object of the invention is to provide a frozen food container of the type as referred to hereinabove and having a semi-rigid plastic dome lid which is locked onto the bottom tray of the container by locking ribs and quickly and readily detachable therefrom without causing damage to the lid in any way.

Another object of the invention is to provide a frozen food container of the type referred to above and the semi-rigid plastic dome lid of which is readily detachable from the tray in a wholly intact condition in all instances to enable subsequent reattachment thereto in the same locked-on manner as before.

Still another object of the invention is to provide a frozen food container of the type referred to above and the dome lid of which is characterized by quick pop-off disengagement and separation from the tray on application of an appropriate separating force to the tray and lid.

A further object of the invention is to provide a frozen food container of the type referred to above and the lock-on dome lid of which is quickly and easily disengageable and separable from the bottom tray merely by a person's single hand without any abrupt snap off action.

Still a further object of the invention is to provide a semi-rigid plastic dome lid for a frozen food container, which lid is provided with a thumb notch recess located in the annular seating flange of the lid in a predetermined spaced position at the corner of the lid and spaced substantially from one of the locking ribs on the seating flange which lock the lid onto the bottom tray of the container whereby lifting of the flange creates a gradual snapping action as the rib disengages the bottom tray.

Yet another object of the invention is to provide a semi-rigid plastic dome lid of a square contour for a frozen food container which lid can be stacked in nested position with other like lids.

Further objects and advantages of the invention will be apparent from the following detailed description of preferred species thereof and from the accompanying drawings

BRIEF DESCRIPTION OF DRAWINGS

FIG. 3 is a top plan view partially cut away showing the preferred embodiment of the present invention;

FIG. 4 is a side view of the preferred embodiment shown in FIG. 3;

FIG. 5 is a bottom view of the preferred embodiment of the present invention;

FIG. 6 is an enlarged plan view showing the preferred embodiment of the present invention in the area of the thumb recess forming the primary aspect of the present invention;

PREFERRED EMBODIMENT OF THE INVENTION

Figure 1:
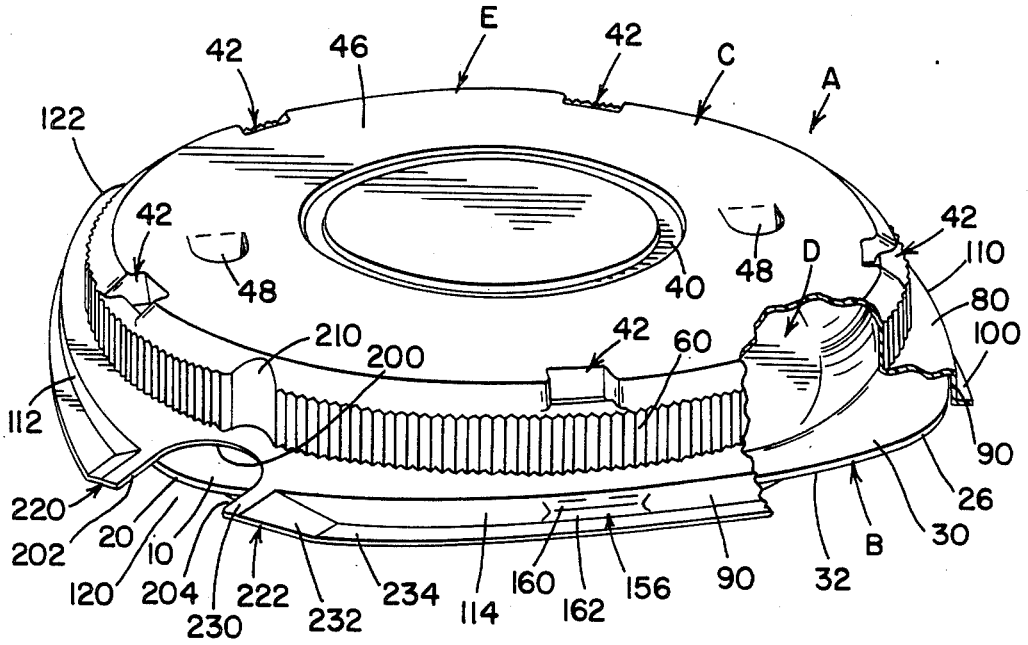
FIG. 1 is a pictorial view of the preferred embodiment of the present invention with a portion cut away.
Figure 2:
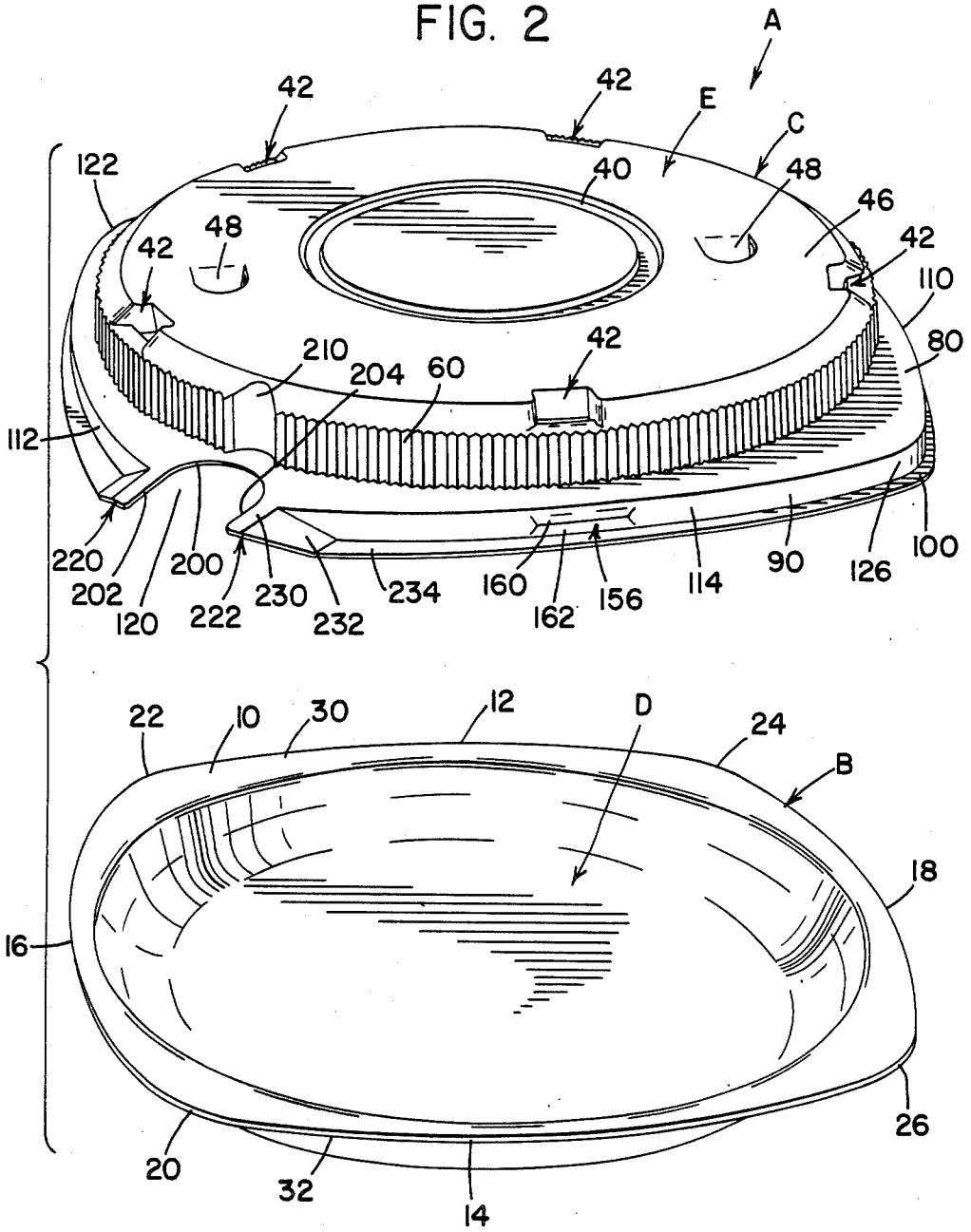
FIG. 2 is an exploded view showing the preferred embodiment of the present invention with the domed lid above the bottom food tray.

Referring to the drawings, wherein the showings are for the purpose of illustrating a preferred embodiment of the invention only, and not for the purpose of limiting same, FIGS. 1 and 2 show a container A of the type used to package and merchandise frozen food for subsequent warming in a microwave oven or a normal convection oven. Container A includes a bottom tray B formed of a rigid plastic and a snap-on dome lid C formed from a semi-rigid plastic sheet, which sheet is somewhat transparent and pressed into the shape of the dome lid.

As shown in FIG. 3, container A has an overall outer periphery generally in rhe shape of a square with arcuate or outwardly curved sides. Within the square shape, tray B has a circular food containing or receiving dish portion D while the dome lid has an upstanding cylindrical dome matching the shape of dish portion D. Bottom tray B is somewhat standard in construction and is quite similar to the bottom tray of U.S. Pat. No. 4,535,880 except for its shape. Lid C and tray B are both formed from a material and are used for the same purposes as corresponding components in my prior patent. The predominant distinction in shape between the prior and new containers is that the container A is generally square with a circular dish portion whereas the container of my prior patent is a somewhat flattened oval outer shape having a matching dish portion. The present invention could be employed with various outer peripheral shapes devised by marketing people for the purpose of packaging frozen foods.

To combine tray B with lid C, the tray includes several structural features provided for function and orientation of the two components of container A. These structural features are illustrated in the lower portion of FIG. 2 as a generally flat locking rim 10 with an outer periphery defined by four generally orthogonal, outwardly bowed, sides 12, 14, 16 and 18 joined together by curved connecting corners 20, 22, 24 and 26. Rim 10 has an upper generally flat surface 30 extending between dish portion D and the outer periphery of the rim defined by the bowed sides and a generally coterminous parallel lower flat locking surface 32. In practice, rim 10 has a thickness between surfaces 30, 32 of about 1/16 inch which thickness is the general wall thickness of all the portions of tray B after it is molded.

Figure 11:
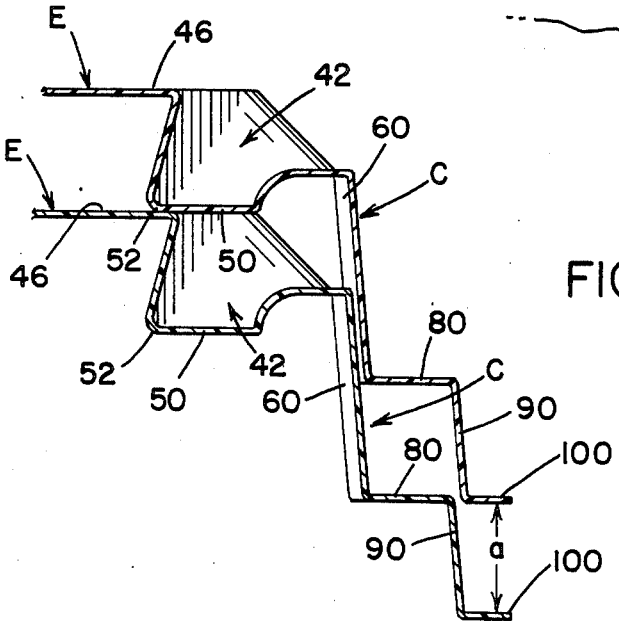
FIG. 11 is a cross-sectional view showing the stacking feature employed in the preferred embodiment of the present invention.

Lid C, with upstanding circular dome E, has a reinforcing ring 40 and a series of five circumferentially spaced indentations 42 all of which are depressions in top circular wall 46. Small flaps 48 are cut in top 46 for venting steam from dome E. These flaps are relatively small so that they may be depressed to allow escape of steam without allowing the finger to pass into the dome. Indentations 42 are formed in top 46 to allow stacking of several lids in a spaced relationship as best shown in FIG. 11. Each indentation includes a bottom spacer wall 50 with an inwardly extending nose portion 52. The nose portion abuts top wall 46 of an adjacent lower lid when lids are stacked. The spacing between bottom spacer wall 50 and circular top wall 46 is distance a and determines the spacing between adjacent lids C in their stacked relationship for the purpose of automatic handling when applying lids over bottom trays after the trays have been filled with food and covered with an upper aluminum foil, not shown. In practice, distance a is approximately 0.29 inches. Around dome E are a series of vertically extending, reinforcing ribs 60 in a pattern having a generally saw toothed configuration. Other formed features in lid C could be provided for allowing stacking of the plastic lids and for reinforcing cylindrical dome E; however, the illustrated features are employed in practice and are shown in the preferred embodiment of the present invention.

Extending radially outwardly from circular dome E is a peripherally extending flat seating flange 80 adapted to overlay flat surface 30 of locking rim 10. The outer periphery of seating flange 80 generally matches the outer periphery of bottom tray B, as best shown in FIGS. 3, 4 and 5. Around the outer periphery of seating flange 80 is a depending, slightly flared, but generally vertical, locking flange or wall 90 terminating in a lower outwardly extending, generally narrow, flat lip 100 provided around lid C, except in the area adjacent corner 20, as shown in FIGS. 3 and 4. Referring more specifically to FIG. 5, the outer periphery of the seating flange 80 or the shape of downwardly extending, depending locking flange or wall 90 is shown. The peripheral contour of seating flange 80 includes arcuately shaped, or outwardly bowed side walls 110, 112, 114 and 116 and corners 120, 122, 124 and 126. Corner 120 is cut away for exposing rim 10 to form a part of the invention. These bowed sides and connecting corners define the outer shape of flange or wall 90 which wall fits over the outer periphery of rim 10 having matching sides and corners, explained in connection with the lower part of FIG. 2.

Figure 10:
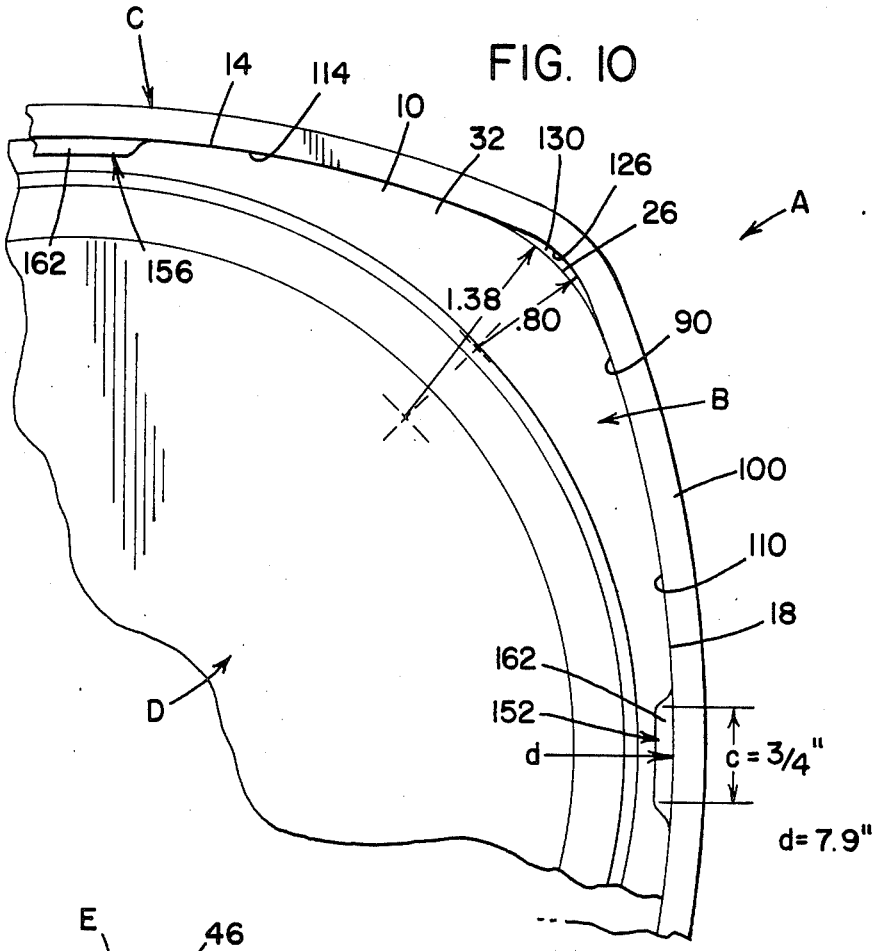
FIG. 10 is a partial, enlarged bottom view showing a certain aspect of the preferred embodiment of the present invention.

As shown in FIG. 10 and in accordance with an aspect of the invention, the radius of curvature of corner 26 on rim 10 is substantially greater than the radius of curvature of corner 126 of depending locking flange or wall 90. The first radius is 1.38 inches and the second radius is 0.80 inches. By this configuration there is a gap 130 between the outer periphery of rim 10 and the inner periphery of wall 90 at three corners of container A. This gap allows flexure of wall 90 toward rim 10 as lid C is snapped on and snapped off of tray B by action of four locking ribs 110, 112, 114 and 116, one on each outwardly bowed side of locking flange or wall 90.

The locking ribs allow a cam action of lid C onto and off of tray B. These ribs are best shown in FIGS. 5, 7, 8 and 9. They hold the lid tight and provide substantial resistance to inadvertent dislodging of the lid during normal handling, while allowing a very smooth jerk-free removal of the lid when desired by a user. Each of these ribs is positioned generally in rhe middle of the arcuate or bowed sides and, in accordance with one aspect of the present invention, the locking ribs have two different configurations. Ribs 150, 152 are located on sides 116, 110, respectively. These sides are opposite to cut away corner 120 and provide a firm holding force against upward movement of lid C. Locking ribs 154, 156 are on sides adjacent cut away corner 120. These ribs are referred to herein as "coacting" ribs since they coact with lift tabs adjacent the cut away corner 120 for the purpose of facilitating smooth removal of lid C from tray B in an improved manner described later and shown in FIGS. 12 and 13. Retainer ribs 150, 152 form a more firm holding action between the surface 32 of rim 10 and tray B than do coacting ribs 154, 156. Both of these ribs have a relatively small width c, as shown in FIG. 10. In practice, this width c is approximately $\frac{3}{4}$ inch in a lid where the spacing between opposite bowed sides and at the greatest diametrical length is approximately 7.9 inches. This container is used in practice and the radius of curvature of the arcuate, bowed sides or walls is about 13.9 inches. The width of locking ribs 150, 152, 154 and 156 is substantially less than the sides on which they are generally centered. This can be defined as a width c less than about 20% of the chordal length of the bowed sides or walls between connecting corners 120, 122, 124, and 126. Lid C is held onto tray B by only four of these locking ribs centered on the four bowed sides of wall 90. The holding action of the ribs is firm; however, in accordance with the present invention, such firm holding action does not hinder easy and smooth releasing of the lid from the tray when desired.

Figure 7:
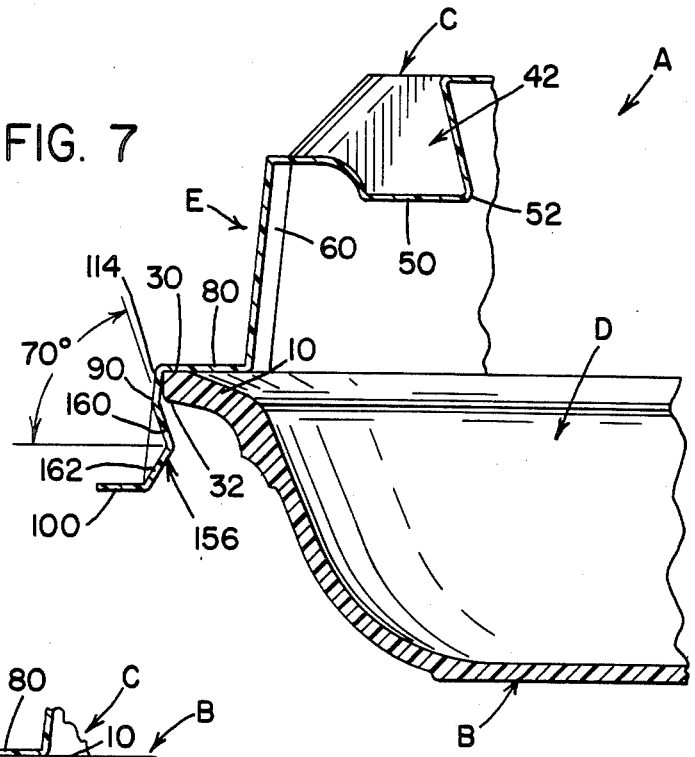
FIG. 7 is an enlarged partial cross-sectional view taken generally along line 7—7 of FIG. 3.
Figure 8:
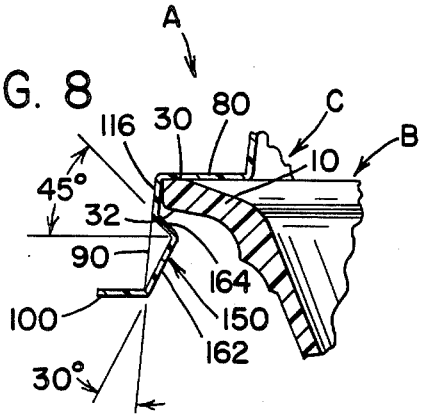
FIG. 8 is an enlarged partial cross-sectional view taken generally along line 8—8 of FIG. 3.
Figure 9:
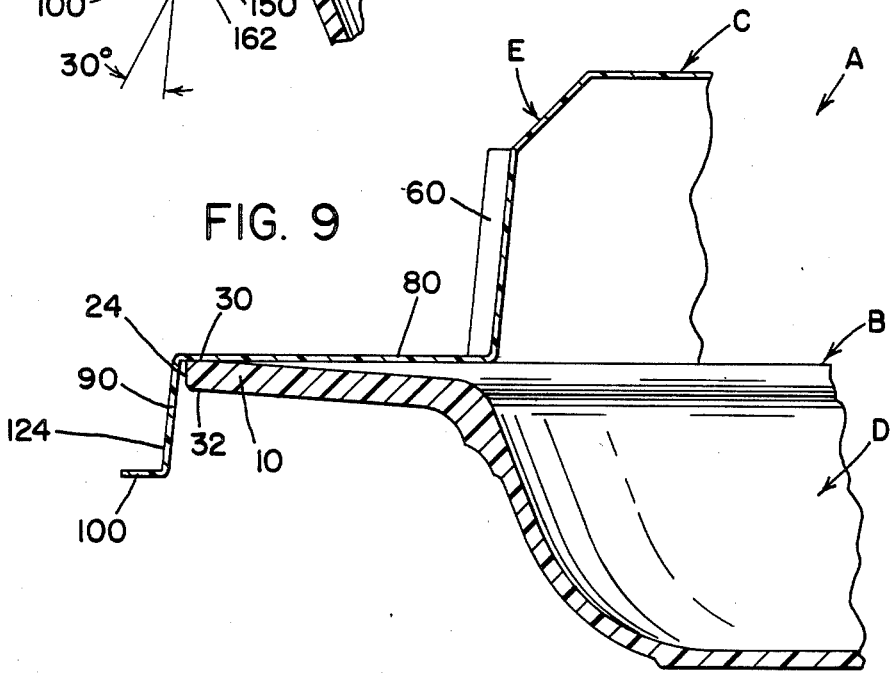
FIG. 9 is an enlarged cross-sectional view taken generally along line 9—9 of FIG. 3.

To appreciate the difference between retainer type locking ribs 150, 152 shown in FIG. 8 and coacting type locking ribs 154, 156 shown in FIG. 7 these ribs will be discussed separately. In FIG. 7, coacting rib 156 includes an upwardly facing cam surface 160 formed at an angle with the horizontal of approximately 70°. By providing an angle of about 20° from vertical, upward release of rim 10 has a controlled lower resistance between rib 156 and rim 10. Lower surface 162 is at an angle of about 20° to 30° to allow a downward snap-on camming action caused by forcing lid C vertically downwardly onto bottom tray B. This assembly operation can be performed conveniently in an automatic assembly machine. In addition, a consumer can snap lid C onto the tray after the aluminum foil has been removed or for any other purpose when heating or consuming the contents of container A. This downward snapping action is facilitated by the corner gaps 130, best shown in FIG. 10. In FIG. 8, retainer type locking rib 150 is illustrated where the upwardly facing cam surface 164 has an angle of approximately 45° with the horizontal. This more abrupt angle provides a better locking action with under surface 32 of rim 10 to hold against a directly vertical upward force. The same downward sloping wall 162 is used on locking rib 150. One of these locking ribs is positioned in the middle of each of the arcuate or bowed sides of wall 90. The gradual slope of lower surface 162 gives a uniform force around the periphery of the container for snapping lid C in place. Locking ribs 150, 152 provide a firmer restraint against upward movement of lid C in the disengaging direction due to the more abrupt upwardly facing cam surface 164. The different upper cam surfaces for the two types of locking ribs facilitates a smoother removal action in accordance with the present invention. Of course, the present invention is still advantageous and would be an improvement even if all locking ribs had the same configuration, such as four ribs like shown in FIG. 8.

As best shown in FIGS. 3 and 6, the primary feature of the present invention involves the use of a thumb notch recess 200 at cut away corner 120 on seating flange 80. This recess is defined by two generally parallel, spaced walls 202, 204 that provide sufficient clearance for a thumb, as shown in FIG. 3, to act against an exposed portion of rim 10. Recess 200 extends outwardly and intersects the periphery of flat flange 80. Only a single thumb recess is provided and it is located in the corner opposite to the two retainer type locking ribs 150, 152 as previously discussed. The vertical indentation 210 is provided in the side of dome E to provide clearance for an easier grasping of rim 10 during the manual manipulative operation used in removing lid C from bottom tray B. Spaced walls 202, 204 define two outwardly protruding, or extending, lifting tabs 220, 222, one of which is lifted upwardly to snap lid C from the bottom tray B. These lifting tabs are substantially identical; therefore, tab 222 and its function with its spaced coacting rib 156 will be described in detail and this description will apply equally to tab 220 and its function with its spaced coacting rib 154. Tab 222 includes a generally flat strip 230 extending along wall 204 and a downwardly angled flap 232 terminating in a flared outwardly lip portion 234 of lower lip 100. Lip 100 is generally uniform around a major portion of the container with a width of about 0.13 inches. The spacing between walls 202, 204 is, in practice, approximately 1.00 inches. The outer tip of flat strip 230 is approximately 1.0 inches from the back portion of recess 200. This back portion of the recess is spaced outwardly from circular dome E about $\frac{1}{8}$ inch, whereas the minimum width of seating flange 80, at the closest position, i.e. between dome E and wall 90, is about $\frac{3}{8}$ inch. These dimensions are provided for the purpose of illustrating the preferred embodiment of the invention and the general size relationship of the various components; however, these dimensions are not intended to be limiting in nature.

Figure 12:
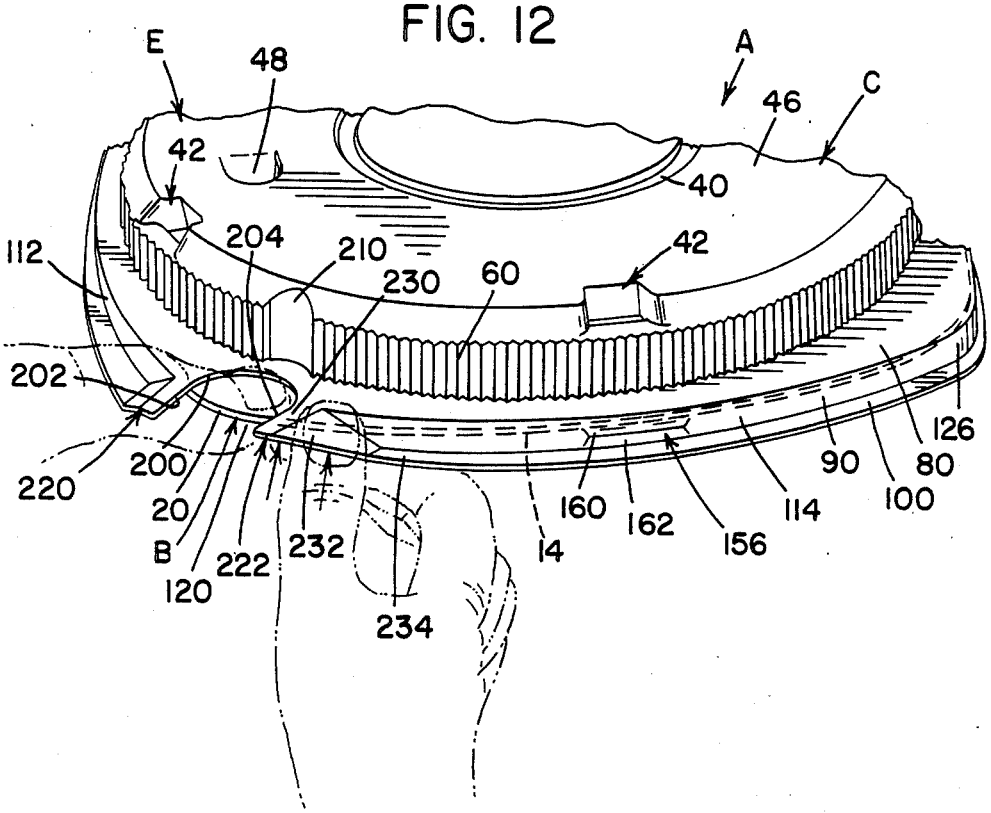
FIG. 12 is a partial pictorial view showing operation of the preferred embodiment of the present invention; and, FIG. 13 is a side view showing a further aspect of the operating characteristics of the present invention illustrated in FIG. 12.
Figure 13:
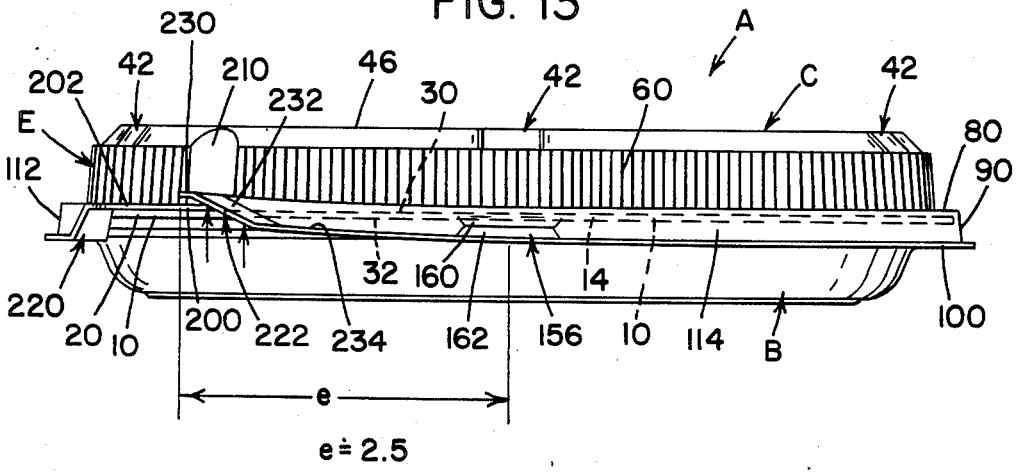

Referring now to FIGS. 12 and 13, operation and advantages of the present invention are illustrated. Flat strip 230 of tab 222 is spaced from the center of locking rib 156 a distance e which is approximately 2.5 inches. Flared outward lip 234, as best shown in FIG. 5, gradually blends the downwardly sloped portion or flap 232 with lip 100 which extends around container A. This substantial spacing which is greater than about 1.5 inches causes an upward bending action for lip 234 as forces are exerted as indicated by the arrows in FIGS. 12 and 13. This bending action develops a mechanical advantage in the lifting action and disengaging action at locking rib 156. This action provides a gradual upward, smooth release action at rib 156. There is no jerk or abrupt snap when locking rib 156 is released from surface 32 of rim 10. As soon as this one coacting rib is released, the other three ribs no longer present a locking action against upward movement of the lid and the lid merely shifts horizontally and slightly vertical to release rim 10. Since the manual unlocking or disengaging action combines a tab coacting with one of the ribs, the particular rib being used is called a "coacting" rib. It coacts with the tab to cause a gradual disengaging action. Both tabs 220, 222 act in the same manner and present left or right releasing actions. This releasing action occurs by upward movement of tab 220 coacting with locking tab 154 in the middle of wall or side 112. Since only a single locking rib is provided in the middle of each of the four arcuate or bowed walls of container A, the gradual vertical release of a coacting locking rib by upward movement of one of the finger tabs releases the total lid immediately. This immediate, smooth release is an improved action not herebefore obtained in the manner employed in the present invention. A large upward movement of one of the lifting tabs creates a relatively small unlocking vertical movement at a coacting locking rib which creates the gradual release action without abruptness and without a sudden jerk. This is an improvement over known containers of the type used in frozen food packaging and does not hinder the vertical holding force of the four ribs. During assembly, lid C may first pass under retaining ribs 150, 152 and then be locked in place by one or both of the other ribs 154, 156. Consequently, ribs 150, 152 can be constructed to have tighter holding actions with the tray rim.

By having lip 234 flared outwardly the flexure is increased from tab 222 to rib 156 along lip 100. Consequently, the area at the tab is somewhat rigid to allow bending in the lever arm toward the rib. Since the release action is somewhat horizontal, ribs 150, 152 could be nearly non-releasable with a horizontal upper surface and still function properly. Of course, a retaining rib could be used at three locations and only a single tab 220 or 222 could be used with only one coacting rib.

Having thus described the invention, the following is claimed:

1. In a container comprised of a molded rigid plastic bottom tray with a surrounding, laterally outward extending flanged rim and an upper dome lid comprised of a semi-rigid sheet-like member of plastic material having a laterally outwardly extending, peripherally extending seating flange matching the contour of, and seated against, the upper surface of and locked onto the said rim of the tray, to join the tray and dome lid together into a unitary assembly, said tray rim and seating flange having four sides joined at corners, the said seating flange having a depending locking flange closely fitting around the flanged rim of the tray, and the said locking flange being provided with a plurality of inwardly projecting, spaced locking ribs engageable with the tray rim under the peripheral outer edge thereof to lock the dome lid in place on the tray, the improvement comprising: said seating flange having an outwardly opening thumb notch recess intersecting the outer peripheral edge thereof, having two opposed edges, and exposing a portion of said tray rim through said recess between said opposed edges, a lid lifting tab extending radially outwardly from said locking flange at each of said opposed edges, each of said tabs being at one side of said lid, and one of said locking ribs being substantially spaced from each of said tabs in directions opposite to said recess to coact with said tabs during removal of said lid from said tray, said coacting rib being on the same one side of said lid as the tab with which it coacts whereby lifting of one of said tabs cams its coacting rib from around the rim of said tray by flexing of said lid between said tab and its coacting rib.

2. The improvement as defined in claim 1 wherein said thumb notch recess is at one of said corners of said seating flange.

3. The improvement as defined in claim 2 wherein said tray includes a generally circular food receiving portion and said dome lid includes a generally circular dome portion matching said food receiving portion and extending upwardly from said peripherally extending seating flange.

4. The improvement as defined in claim 3 wherein one of said locking ribs is located on each side of said locking flange.

5. The improvement as defined in claim 4 wherein said locking ribs have upwardly facing cam surfaces each with a downwardly and inwardly facing slope of a given angle.

6. The improvement as defined in claim 5 wherein said coacting ribs and said other ribs have different given angles to the slopes of said cam surfaces thereof.

7. The improvement as defined in claim 6 wherein said angles of the slopes of said coacting ribs are greater, as measured from a horizontal plane, than the angle of said locking ribs not coacting with a lifting tab.

8. The improvement as defined in claim 7 wherein said locking ribs have a width of less than about 1.0 inches.

9. The improvement as defined in claim 8 wherein the width of said locking ribs is substantially less than about 15% of the length of said side of said locking flange upon which said rib is provided.

10. The improvement as defined in claim 9 wherein the corners of said tray rim have a greater radius of curvature than the corners of said seating flange whereby said corners of said seating flange may flex toward said corners of said rim when said ribs cam over said peripheral outer edge cf said tray rim.

11. The improvement as defined in claim 10 wherein said sides of said seating flange and said matching sides of said tray rim are arcuate with essentially equal radii of curvature.

12. The improvement as defined in claim 2 wherein one of said locking ribs is located on each side of said locking flange.

13. The improvement as defined in claim 1 wherein one of said locking ribs is located on each side of said locking flange.

14. The improvement as defined in claim 2 wherein said locking ribs have upwardly facing cam surfaces each with a downwardly and inwardly facing slope of a given angle.

15. The improvement as defined in claim 14 wherein said coacting ribs and said other ribs have different given angles to the slopes of said cam surfaces thereof.

16. The improvement as defined in claim 15 wherein said angles of the slopes of said coacting ribs are greater, as measured from a horizontal plane, than the angle of said locking ribs not coacting with a lifting tab.

17. The improvement as defined in claim 14 wherein said angles of the slopes of said coacting ribs are greater, as measured from a horizontal plane, than the angle of said locking ribs not coacting with a lifting tab.

18. The improvement as defined in claim 15 wherein said locking ribs have a width of less than about 1.0 inches.

19. The improvement as defined in claim 17 wherein said locking ribs have a width of less than about 1.0 inches.

20. The improvement as defined in claim 1 wherein said locking ribs have upwardly facing cam surfaces each with a downwardly and inwardly facing slope of a given angle.

21. The improvement as defined in claim 20 wherein said coacting ribs and said other ribs have different given angles to the slopes of said cam surfaces thereof.

22. The improvement as defined in claim 21 wherein said angles of the slopes of said coacting ribs are greater, as measured from a horizontal plane, than the angle of said locking ribs not coacting with a lifting tab.

23. The improvement as defined in claim 1 wherein said locking ribs have a width of less than about 1.0 inches.

24. The improvement as defined in claim 1 wherein the width of said locking ribs is substantially less than about 15% of the length of said side of said locking flange upon which said rib is provided.

25. The improvement as defined in claim 2 wherein the corners of said tray rim have a greater radius of curvature than the corners of said seating flange whereby said corners of said seating flange may flex toward said corners of said rim when said ribs cam over said peripheral outer edge of said tray rim.

26. The improvement as defined in claim 25 wherein said sides of said seating flange and said matching sides of said tray rim are arcuate with essentially equal radii of curvature.

27. The improvement as defined in claim 1 wherein the corners of said tray rim have a greater radius of curvature than the corners of said seating flange whereby said corners of said seating flange may flex toward said corners of said rim when said ribs cam over said peripheral outer edge of said tray rim.

28. The improvement as defined in claim 27 wherein said sides of said seating flange and said matching sides of said tray rim are arcuate with essentially equal radii of curvature.

29. The improvement as defined in claim 2 wherein said sides of said seating flange and said matching sides of said tray rim are arcuate with essentially equal radii cf curvature.

30. The improvement as defined in claim 1 wherein said sides of said seating flange and said matching sides of said tray rim are arcuate with essentially equal radii of curvature.

31. In a container as defined in claim 1, wherein the said inwardly projecting locking ribs on said locking flange are of V-shaped form and extend lengthwise along the respective said sides thereof, the sloping faces of said locking ribs camming against the said peripheral outer edge of the tray rim on application of a separating force couple to the locking flange to distort the corner of the locking flange on the opposite side of the coacting locking rib from said lifting tab associated with said locking rib in a laterally inward direction so as to disengage said coacting rib from under the tray rim and effect the separation of the lid from the tray at said coacting locking rib.

32. A dome lid for locking attachment onto a bottom tray having a surrounding laterally outward extending flanged rim of generally square contour with gradually rounded corner portions and arcuate sides, said lid comprising a semi-rigid sheet-like member of plastic material having a laterally outward extending annular seating flange matching the contour of and adapted for seating against the upper surface of and locking onto the said rim of the tray, said seating flange having a depending locking flange for fitting closely around the flanged rim of the tray and having gradually rounded corner portions matching the said rounded corner portions of said flanged rim, said locking flange being provided with a plurality of inwardly projecting locking ribs spaced therearound and located within the peripheral extent of respective ones of the said arcuate sides of said locking flange for engagement with the tray rim under the peripheral outer edge thereof to lock the dome lid in place on the tray, and said seating flange having an outwardly opening thumb notch recess in the outer peripheral edge thereof for exposing therethrough a portion of the tray rim, said thumb notch recess being spaced along said seating flange a substantial distance from an adjacent one of said locking ribs whereby said seating flange portion between said notch and said adjacent one of said locking ribs flexes as said flange is lifted at said notch to disengage said adjacent one of said ribs from said tray rim when said dome lid is removed from said tray.

33. In a container comprised of a molded rigid plastic bottom tray with a surrounding, laterally outward extending flanged rim and an upper dome lid comprised of a semi-rigid sheet-like member of plastic material having a laterally outwardly extending, peripherally extending seating flange matching the contour of, and seated against, the upper surface of and locked onto the said rim of the tray, to join the tray and dome lid together into a unitary assembly, said seating flange having a depending locking flange closely fitting around the flanged rim of the tray, and the said locking flange being provided with a plurality of inwardly projecting, spaced locking ribs engageable with the tray rim under the peripheral outer edge thereof to lock the dome lid in place on the tray, the improvement comprising: said seating flange having an outwardly opening thumb notch recess intersecting the outer peripheral edge thereof, having two opposed edges, and exposing a portion of said tray rim through said recess between said opposed edges, a lid lifting tab extending radially outwardly from said locking flange at one of said opposed edges, one of said locking ribs being substantially spaced from said tab in a direction opposite to said recess to coact with said tab during removal of said lid from said tray whereby lifting of said tab cams its coacting rib from around the rim of said tray by flexing of said lid between said tab and its coacting rib.

34. The improvement as defined in claim 33 wherein said tray rim has four sides joined at corners.

35. The improvement as defined in claim 34 wherein only one of said locking ribs is located on each of said four sides.

* * * * *

UNITED STATES PATENT AND TRADEMARK OFFICE

CERTIFICATE OF CORRECTION

PATENT NO. : 4,687,117

DATED : August 18, 1987

INVENTOR(S) : Oskar R. Terauds

It is certified that error appears in the above-identified patent and that said Letters Patent are hereby corrected as shown below:

In the Title Page, Item [56] References Cited, U.S. Patent Documents, "4,183,466" should read --- 4,183,446 ---. Column 3, line 63, "plan" should read --- side ---; after "view" insert --- along line 6-6 of FIG. 3 ---. Column 4, line 36, after "dome" insert --- E ---; line 39, "4535,880" should read --- 4,535,889 ---. Column 5, line 57, "110, 112, 114 and 116" should read --- 150, 152, 154 and 156 ---; line 61, "9" should read --- 10 ---; line 65, "rhe" should read --- the ---. Column 6, line 36 (actual), "10" should read --- 80 ---. Column 8, line 13, "lid C" should read --- rim 10 of tray D ---.

Signed and Sealed this

Twelfth Day of April, 1988

*Attest:*

DONALD J. QUIGG

*Attesting Officer*

*Commissioner of Patents and Trademarks*